US011164428B1

(12) United States Patent
Shoemaker, Jr.

(10) Patent No.: US 11,164,428 B1
(45) Date of Patent: Nov. 2, 2021

(54) CRANE-STYLE ARCADE GAME WITH TURNTABLE MECHANISM

(71) Applicant: Stephen P. Shoemaker Trust, Manhattan Beach, CA (US)

(72) Inventor: Stephen P. Shoemaker, Jr., Redondo Beach, CA (US)

( * ) Notice: Subject to any disclaimer, the term of this patent is extended or adjusted under 35 U.S.C. 154(b) by 0 days.

(21) Appl. No.: 17/339,823

(22) Filed: Jun. 4, 2021

(51) Int. Cl.

| | |
|---|---|
| ***G07F 17/32*** | (2006.01) |
| ***A63F 9/30*** | (2006.01) |
| ***A63F 3/00*** | (2006.01) |
| ***A63F 9/00*** | (2006.01) |

(52) U.S. Cl.
CPC ..... *G07F 17/3297* (2013.01); *A63F 9/30* (2013.01); *A63F 2003/00274* (2013.01); *A63F 2009/0081* (2013.01)

(58) Field of Classification Search
CPC ..... G07F 17/3297; A63F 9/30; A63F 2009/0081; A63F 2003/00274
See application file for complete search history.

(56) References Cited

U.S. PATENT DOCUMENTS 327,032 A * 9/1885 Stevens ..... A47B 11/00 108/139
1,978,695 A * 10/1934 Clark ..... F25D 25/027 211/77
4,778,176 A * 10/1988 Shoemaker, Jr. ..... A63F 9/30 212/225
5,166,486 A * 11/1992 Komatsu ..... H05B 6/6411 219/754
5,318,299 A * 6/1994 Beaster ..... A63F 3/00157 108/139
5,435,556 A * 7/1995 Rice ..... A63F 5/04 273/138.2
5,855,374 A * 1/1999 Shoemaker, Jr. ..... A63F 9/30 273/447
7,168,702 B1 * 1/2007 Shoemaker ..... A63F 7/28 273/138.1
9,526,978 B1 * 12/2016 Shoemaker, Jr. ... G07F 17/3246
2007/0283860 A1 * 12/2007 Sun ..... A47B 11/00 108/94
2013/0032009 A1 * 2/2013 Hui ..... B25B 13/06 81/124.6

* cited by examiner

*Primary Examiner* — Michael D Dennis
(74) *Attorney, Agent, or Firm* — Fulwider Patton LLP

(57) ABSTRACT

The present invention is directed to an arcade type vacuum crane game that includes a turntable with a target support structure such as cylindrical, open ended target holders to prevent targets from toppling before, during, and after playing the game. The turntable is rotated by a centrally disposed motor having a shaft that receives a projection on the turntable to rotate the turntable in the direction of the shaft. The shaft receives the peg therein, but does not carry the weight of the turntable, which instead is supported by three peripheral rotatable wheels disposed about the motor on a bracket. Because the turntable is simply mounted over the shaft using a fitted mating, the turntable can be lifted off the motor without tools and another turntable set on top of the shaft and wheels quickly and easily.

5 Claims, 6 Drawing Sheets

CRANE-STYLE ARCADE GAME WITH TURNTABLE MECHANISM

BACKGROUND

This invention relates generally to arcade games with a crane mechanism, and more particularly to a vacuum crane game with a rotating playing field where prizes are arranged on a turntable, and where the turntable is supported by three wheels that distribute the loading in the event of uneven prize distribution and allows interchangeable with other turntables for quick replacement.

Arcade games are well known in the art, and particularly crane-type games where players maneuver a crane over targets in an attempt to extract the target from a playing field. The targets for claw-type arcade games have traditionally been plush toys. However, the allure of plush toys, while popular with some, is not always an attraction for all players, particularly teens and young adults. Unfortunately, prizes that would be attractive to these players are not readily compatible with claw mechanisms. Thus, a large population of would-be players is lost due to the discrepancy between the types of prizes players want and a game that can work with such prizes that cannot be picked up with a claw type grasp. This led to the advent of the vacuum crane, which allowed for all different kinds of prizes including cylinders and aluminum cans. See U.S. Pat. Nos. 10,902,704 and 10,792,559 to the present inventor, the contents of which are incorporated herein by reference.

The present invention is an arcade game with a crane mechanism that uses a suction device to capture and extract smooth prizes such as aluminum cans of beverages, batteries, cylindrical prize holders, gumballs, trading cards, and other smooth surface cylindrical or geometric targets. The present invention provides a game that uses these cylindrical or other geometric shapes as targets for a crane game, offering players a choice of different prizes to try and capture. In most cases, the targets have a smooth, relatively flat upper surface so that a suction cup may be lowered as part of the crane mechanism and attach to the smooth upper surface for extraction from the playing field.

The arcade game may use a rotating playing field where the targets sit on a turntable type rotating disk, preferably with fixed supports or holders that establish the spacing for the targets and prevent the targets from tipping over during play. Having prizes supported individually makes the legality of the game acceptable in some jurisdictions, since some state laws require that the player be able to win all of the prizes shown in the playing field. Using a rotating playing field and turntable also has the benefit of simplifying the movement of the pick-up device, since the pick-up device may move linearly across the turntable as the targets pass below the crane and still access every position on the turntable. The player controls the pick-up device with a joystick, buttons, a touchpad, a lever, or other type of player input device to maneuver the pick-up device over the intended target, and then the game lowers the pick-up device onto a target/prize in an attempt to extract the target from the playing field.

In the case of beverages such as sodas or energy drinks, the cans are inverted, i.e. placed upside down, because the lower surface of the can is round, smooth, flat, consistently sized, and make a perfect target for the suction cup. The pick-up device preferably uses a suction cup that, if positioned directly over the upper surface of the target, will make a seal with the upper surface and allow the target to be lifted from the playing field. If the suction cup is not placed directly over the target such that a seal is not established, the pick-up device will not be able to apply a fully negative pressure between the target's upper surface and the pick-up device, and the attempt will fail. In the event of a successful attempt, the target is lifted and moved to a retrieval bin adjacent the playing field where the player can obtain the prize. When the play is finished, the pick-up device returns to a parked position ready for the next play.

One issue with the present invention is the need for a rotating mechanism for the game that is bi-direction and is not affected by an unequal distribution of prizes. Since players do not select prizes based on the current distribution, the weight of the beverages or prizes can cause the turntable to wobble or rub in the current arrangement. Further, the game must be stopped and placed out of service while the game is replenished. It would be advantageous to have an interchangeable turntable that can be quickly replaced without appreciable delay, and have the turntable supported in a manner that reliably protects the motor from undue loading while promoting a smooth and even motion of the turntable. The present invention is designed to address these needs.

SUMMARY OF THE INVENTION

The present invention is directed to a crane game that includes a plurality of interchangeable turntables that can be quickly removed and replaced without undue disruption of the game. The turntable assembly of the present invention is simple to assemble, reliable and has a number of advantages over the prior art. Three wheels disposed at the perimeter of the turntable support the turntable evenly and carry the weight of the table without unduly loading the motor such that the motor simply rotates the table from its center. This removes the motor from having to carry the weight of the table, which can lead to problems with the motor and premature wear. Instead, in the present invention the three-wheel support allows the turntable to rotate both clockwise and counter-clockwise with equal ease and the motor simply provides the rotation without supporting the weight. In the event that prizes are removed from one side creating an off-balance condition, the wheels even out the loading and there is not stress on the motor. The assembly also permits removal and replacement of the turntable in a quick and reliable manner. If a replacement turntable is preloaded with prizes, the proprietor need only open the game, remove the depleted turntable, insert the loaded turntable, and close the game and the process does not interfere with the operation of the game. Using different turntables can also permit different prizes and different arrangements of those prizes based on the skill of the players and the value of the prizes. For example, one turntable can be for beginners and another turntable can be for experts, with different prize values and spacing between the prizes.

These and other benefits of the present invention will best be understood with reference to the detailed description of the invention below, along with the accompanying drawings.

DETAILED DESCRIPTION OF THE PREFERRED EMBODIMENTS

Figure 1:
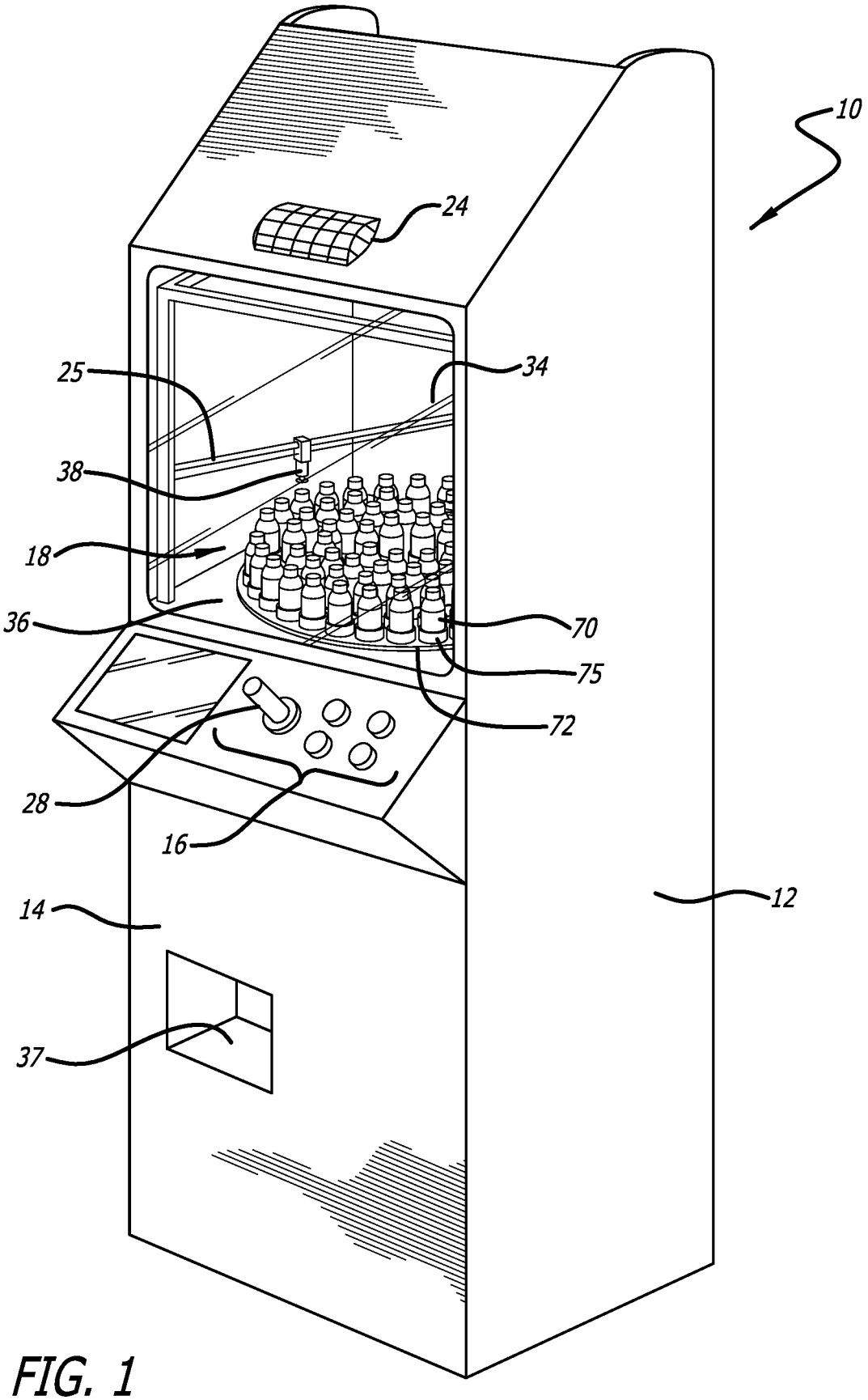
FIG. 1 is an elevated, perspective view of an arcade game of the type that uses a turntable arrangement of the present invention.

The type of crane game that serves as the environment for the present invention is disclosed in U.S. patent application Ser. No. 16/352,532 by the present inventor, the content of which is incorporated by reference herein in its entirety. FIG. 1 illustrates a vacuum type crane game found in arcades, boardwalks, and other locations where coin operated games are played. The vacuum pick-up device is similar to the device disclosed in the present inventor's U.S. Pat. No. 5,855,374 entitled Crane Game Including Vacuum And Rotary Table, the content of which is also fully incorporated herein by reference. Depicted is the game apparatus 10 which includes a housing 12, front panel 14, player controls 16, and a playing area 18.

Housing 12 provides a support for the other components of the game apparatus. Housings can take a wide variety of forms; for example, as shown in FIG. 1, housing 12 may be of the stand-up arcade game variety in which a player stands in front of the game or sits on a stool when playing the game. In other embodiments, other types of housings may be provided. For example, a counter-top housing, including approximately the upper half of housing 12 shown in FIG. 1, can be used when the game apparatus is desired to be placed on a table, countertop, or other similar surface.

Front panel 14 can be positioned below and/or above the player controls 16 and playing field 18, as shown in FIG. 1. The front panel can also be positioned in a wide variety of other locations on housing 12.

A pick-up device is used to both capture the targets in the playing field and to deliver any successfully captured prizes from playing area 18 to a player-accessible retrieval bin where the player retrieves the prize. With carbonated beverages, transfer of the prize may need to extend all the way to the floor of the retrieval bin so as not to agitate the beverage and cause it to spray out when opened. Speaker(s) 24 emits sounds based on game actions and other game states and is controlled by a game control system.

Player controls 16 allow a player to manipulate events in the game, and typically include a joystick, buttons, switch, knob, or the like. Game action occurs in playing area 18, where a pickup mechanism may be controlled and guided by the player to pick up prize objects, as described below. In the embodiment of FIG. 1, a joystick 28 or similar device (knob, two buttons, etc.) can be manipulated by the player to move the pick-up device in a linear direction (forward and backwards) along a fixed support beam 25. Buttons can also be provided to select various game functions, such as additional velocity control of the pick-up device, number of players in a game, a start button to begin the game, etc. For example, in the described embodiment, a stop or slow button can be pressed by the player to slow down (or stop) the rotational movement of a prize turntable so as to allow the player to more accurately position the pick-up device. In alternate embodiments, the player may be able to control motion of other components of the game, such as horizontal or downward movement of the pick-up device. In some embodiments, a player may get multiple chances to guide the pick-up mechanism with one coin or credit, or, alternatively, the player may be required to insert additional coins.

Game playing area 18 is used to display the game action and prizes to a player and is the area where game action occurs. A transparent shield 34 can prevent the player from interfering with game action. The playing area 18 houses a prize display area 36, a vacuum pick up device 38, and a drive system (not shown) for moving the pick-up device 38. The pick-up device 38 is a suction cup that is connected to a vacuum where a negative pressure can be created if the suction cup makes a seal with a surface on the target. The player guides the pick-up device 38 horizontally over the playing field, and then either the player of the automatic control of the game lowers the pick-up device 38 over a selected prize in an attempt to capture the prize. If a prize is picked up, the game controller automatically guides the pick-up device 38 with the prize attached to a passage that leads to the player's retrieval bin 37.

A vacuum is connected to the pick-up device 38 by tube which communicates a negative pressure to the suction cup. Signals from either the player or a motherboard (not shown) are sent to a motor that rotates in two directions and is connected to a cable. Cable passes through several pulleys and controls the movement of a carriage mounted on support beam. Controlling the motor can move the carriage fore and aft, from the center of the playing field to the outer edge of the turntable 72. As the turntable rotates, the carriage can be located over every spot where targets are disposed, allowing the player to capture any target below. Further details of the pick-up device can be found in the present inventor's U.S. Pat. No. 10,109,159 entitled Arcade Game With Prize Distribution And Collection System And Method, the contents of which are fully incorporated herein by reference.

The targets 70 are shown as beverages in FIG. 1 but may be any prize with a smooth upper surface extending upward from the turntable 72, which in turn is rotated by motor 74. The smaller upper surface provides an impediment to successfully capturing the target 70, because if the suction cup does not land completely on the smooth top surface, the pick-up device 38 cannot engage the target 70 fully and a negative pressure in the suction cup will be lost. However, if the player successfully maneuvers the pick-up device 38 so that the suction cup does squarely land onto the smooth upper surface of the target, then the pick-up device 38 will successfully capture the target and deliver the target to the retrieval bin without dropping. The diameter of the suction cup relative to the diameter of the target partially determines the requisite skill needed to successful extract the can. Other factors include the distance between the cup and the can, the speed of the device, and the tolerances of the controls in effecting the outcome and skill of the attempt.

In this manner, many different types of prizes can be used while still utilizing the vacuum pick up device as the mode of acquiring the targets 70.

Figure 2:
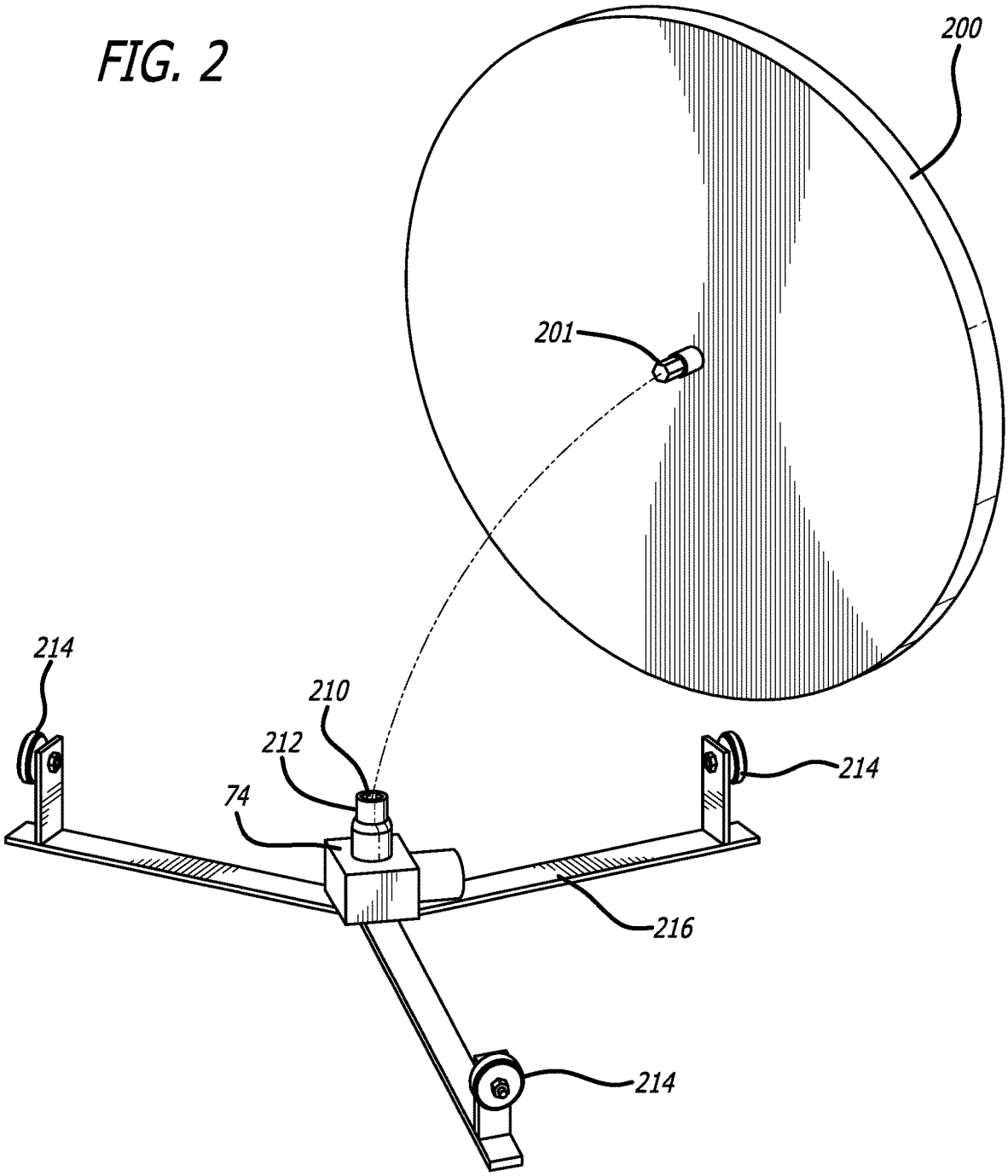
FIG. 2 is an elevated, perspective view of a turntable assembly of the present invention.

FIG. 2 illustrates a turntable assembly that includes a disk 200) with a centered perpendicular projection 201, such as a hexagonal peg that fits into and engages a hexagonal socket 210 in the upper section of the rotating shaft 212 of motor 74. Note that any non-circular profile will work as long as the projection and socket have complimentary shapes and the projection cannot rotate with respect to the socket but must rather rotate with the socket 210. An example would be a 7/16ths inch bolt with a 7/16ths inch socket. The disk 200 sits on three vertically arranged and equally spaced wheels 214 mounted on the bracket 216, where the wheels 214 arc journaled to permit free rotation. The height of the wheels 214 is such that the projection 201 does not engage with the bottom of the hexagonal socket 210, and the motor shaft 212 does not carry the weight of the disk 200. Rather, the weight of the disk 200 is borne by and equally carried by the three wheels 214 while the motor shaft 212 simply turns the disk about its central axis in a horizontal plane. The motor 74 is preferably reversible so that the turntable can rotation in either direction depending on the direction of the rotation of the shaft 212. It is understood that while three wheels 214 are shown, additional wheels spaced apart in equal intervals would fall within the scope of the invention and should be considered part of the invention's scope.

Figure 3:
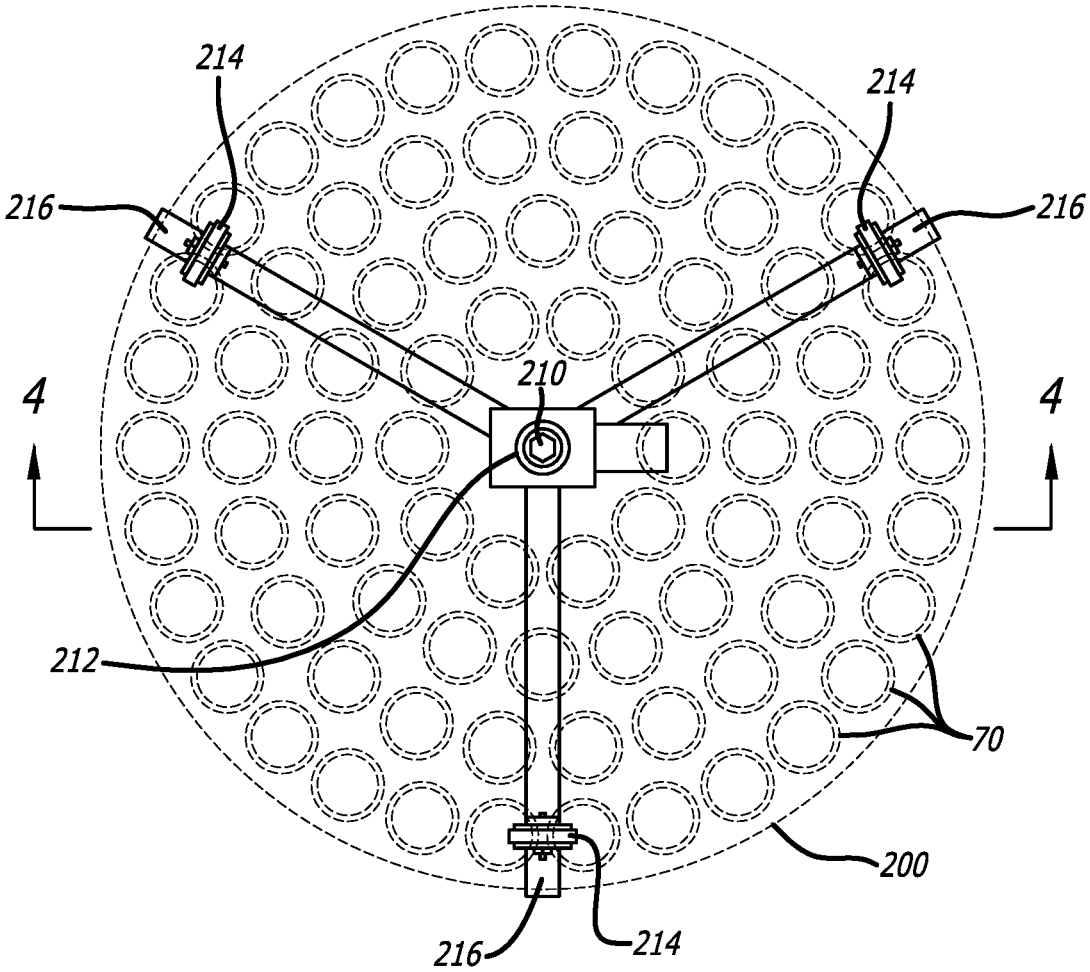
FIG. 3 is a bottom view, partially in shadow, of the turntable assembly.
Figure 4:
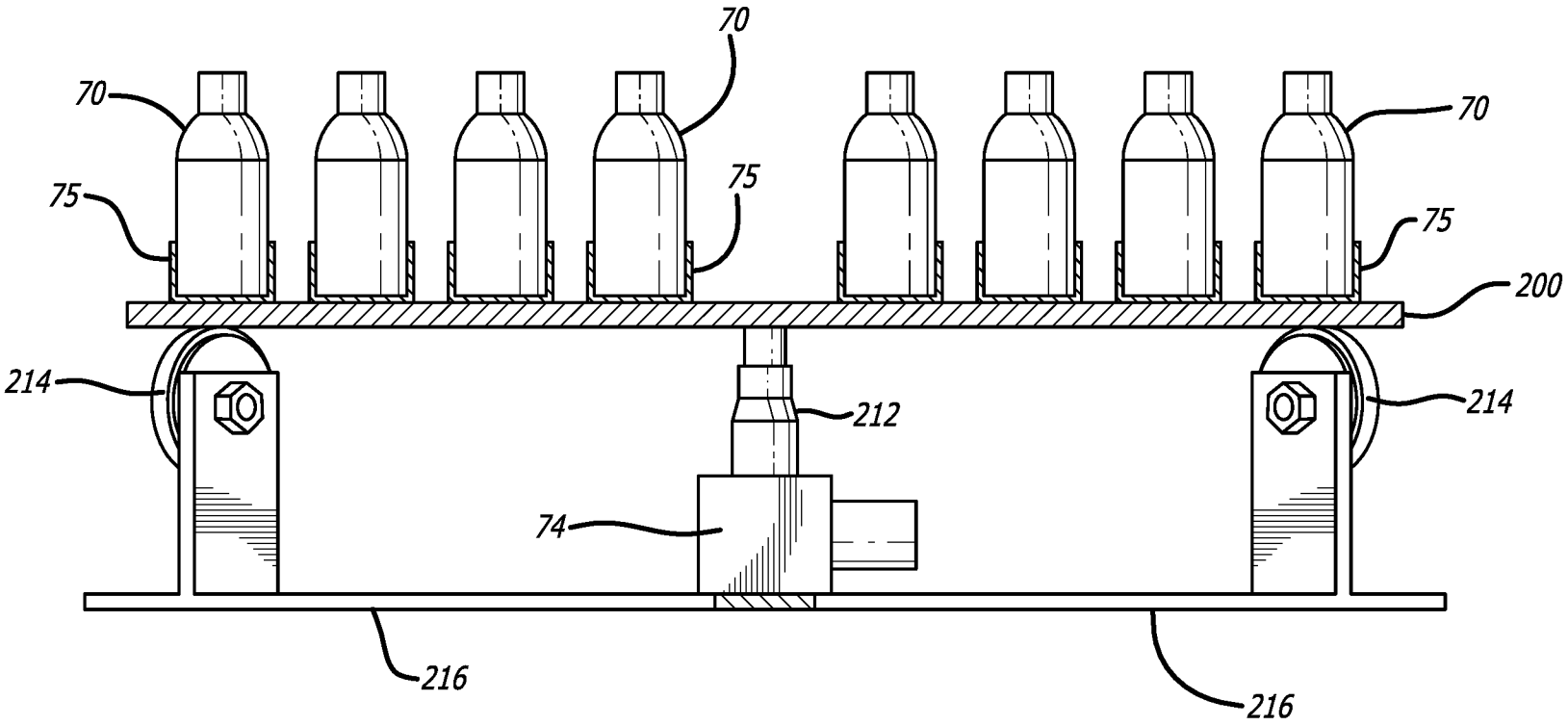
FIG. 4 is a cross sectional view of the turntable assembly.
Figure 5:
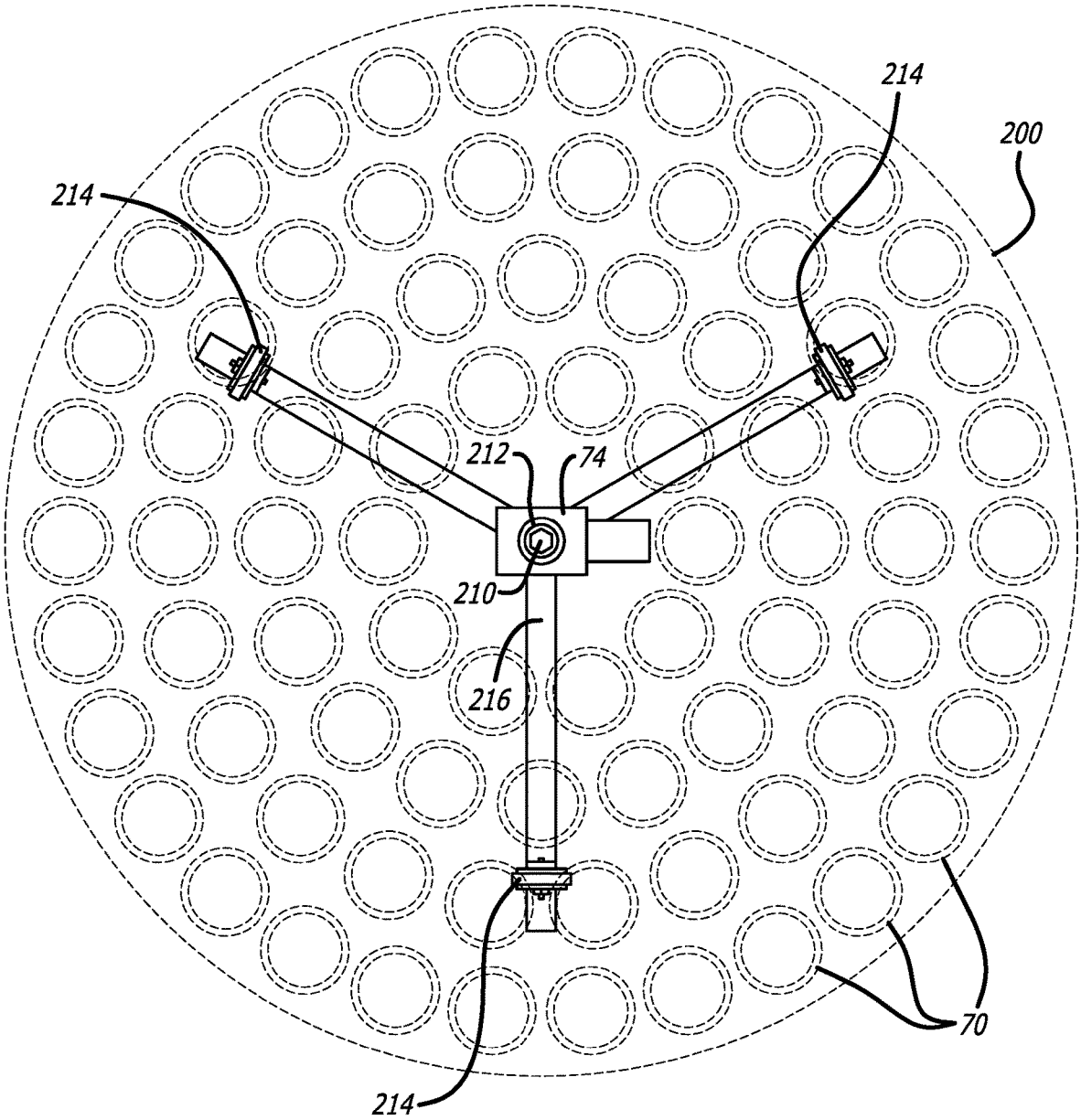
FIG. 5 is a bottom view of an alternate turntable assembly of the present invention.
Figure 6:
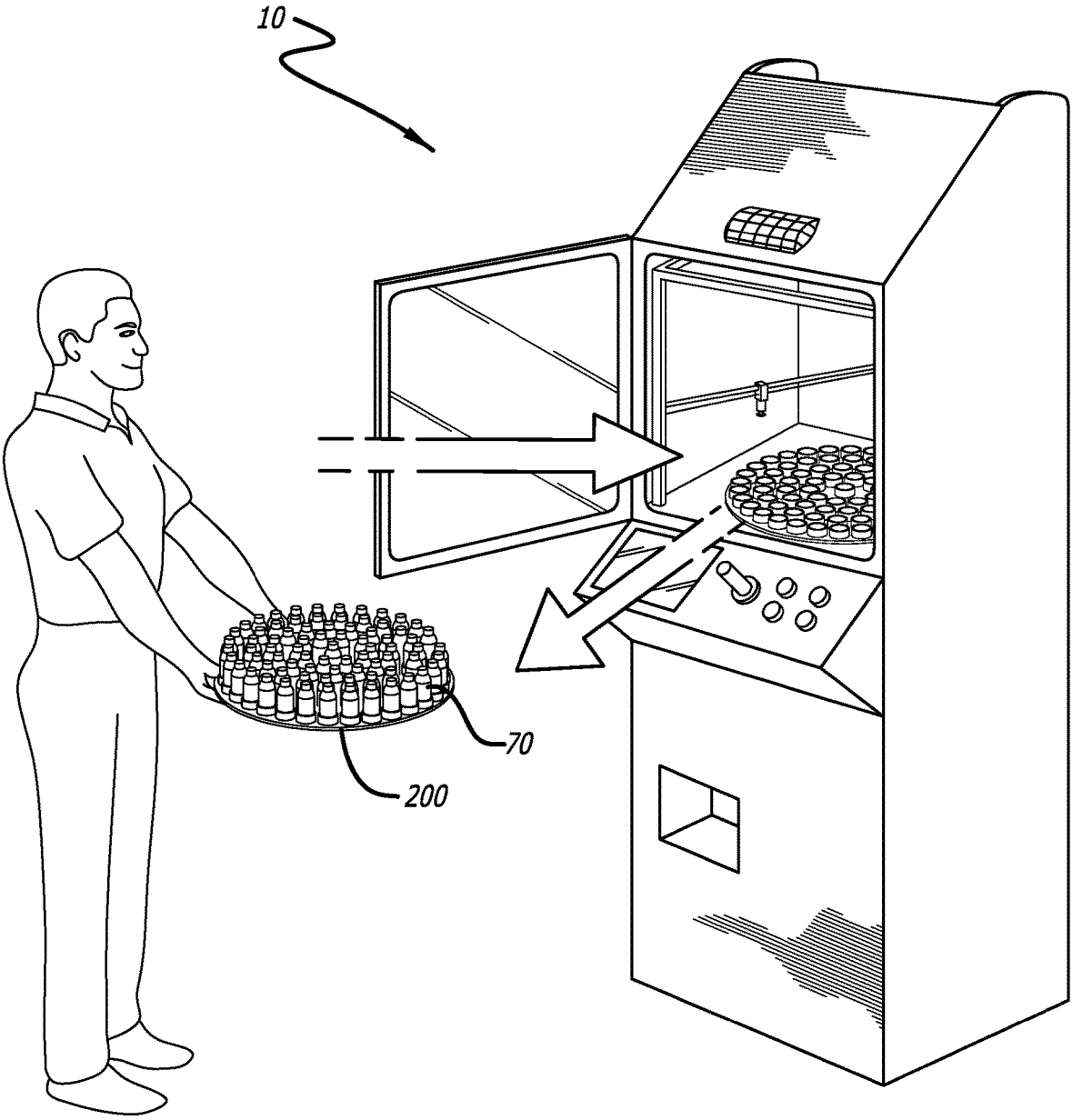
FIG. 6 is an elevated, perspective view showing the interchangeability of the turntable assembly.

FIG. 3 shows a bottom view of the motor 74, the bracket 216, the wheels 214, and the underside of the disk 200 with the targets shown in shadow. The disk 200 sits on the wheels 214 and turns under the influence of the motor 74 via the projection 201 as described above. In FIG. 5, a larger disk 211 is shown on the same wheels and motor assembly, illustrating the versatility of the assembly for carrying multiple turntables. In FIG. 4, a side view of the turntable shows the disk 200 supporting the targets 70 in their respective holders 75 on top of the disk. Below, the motor 74 and its shaft 212 spin the disk 200 in a horizontal plane while wheels 214 carry the weight of the disk and the targets. The bracket 216 is mounted to the housing so that the weight is ultimately transferred to the housing while the motor only has to move the disk in one of two directions. FIG. 6 illustrates a benefit of the invention, where multiple disks can be preloaded with targets to easily replace depleted turntables without delay. Note that since the turntable is not fastened to the motor but rather simply sits above it, the turntable can easily be removed without tools by simply lifting the turntable off of the wheels and the motor's shaft. Therefore, replacement of the empty turntable with a full turntable is a quick and easy process.

Without this removable turntable, the tedious task of positioning the targets one by one prevents the game from being played while this operation takes place, wasting time when the game could be generating revenue.

A person of ordinary skill in the art will readily recognize that several variations, modifications, and substitutions are possible with the present invention, and the inventor intends to incorporate all such variations, modifications, and substitutions as part of the invention. Accordingly, the invention should not be limited to any particular disclosed or depicted embodiment, but rather the scope of the invention is properly determined by the construction of the appended claims using their ordinary meanings, consistent with but not limited by the descriptions and depictions herein.

I claim:

1. A crane game including a pick-up device, player controls, and a housing surrounding a playing field, comprising:

a plurality of targets arranged on a first turntable, the first turntable having a centrally disposed perpendicular projection having a non-circular cross-section;

a motor having a vertical shaft centrally disposed below the first turntable, the shaft including a socket sized and shaped to receive the perpendicular projection therein to rotate the first turntable when the vertical shaft rotates; and a support bracket attached to the motor, the support bracket including three wheels configured for rotation about a horizontal axis and located below the first turntable and in contact therewith;

wherein the weight of the first turntable is fully borne by the support bracket and not by the shaft of the motor; and wherein the first turntable can be removed from its engagement with the motor's shaft solely by lifting the first turntable off the support bracket.

2. The crane game of claim 1, further comprising a second turntable that is interchangeable with the first turntable.

3. The crane game of claim 2, where the second turntable is of a different size from the first turntable.

4. The crane game of claim 1, wherein the motor is reversible.

5. The crane game of claim 1, wherein the perpendicular projection has a hexagonal cross-sectional profile and the socket in the motor's shaft is hexagonal.

* * * * *